US006511555B2

(12) United States Patent
Feikus et al.

(10) Patent No.: US 6,511,555 B2
(45) Date of Patent: Jan. 28, 2003

(54) CYLINDER HEAD AND MOTOR BLOCK CASTINGS

(75) Inventors: Franz Josef Feikus, Bonn (DE); Leonhard Heusler, St. Augustin (DE)

(73) Assignee: Vaw Aluminium AG, Bonn (DE)

( * ) Notice: Subject to any disclaimer, the term of this patent is extended or adjusted under 35 U.S.C. 154(b) by 0 days.

(21) Appl. No.: 09/952,166

(22) Filed: Sep. 12, 2001

(65) Prior Publication Data

US 2002/0053373 A1 May 9, 2002

Related U.S. Application Data

(62) Division of application No. 09/585,091, filed on Jun. 1, 2000.

(30) Foreign Application Priority Data

Jun. 4, 1999 (DE) ..... 199 25 666

(51) Int. Cl.[7] ..... C22C 21/02

(52) U.S. Cl. ..... 148/417; 420/532; 420/535; 420/538; 420/553

(58) Field of Search ..... 148/417, 439; 420/532, 535, 538, 553

(56) References Cited

U.S. PATENT DOCUMENTS

| | | | | |
|---|---|---|---|---|
| 4,336,076 | A | 6/1982 | Edamura et al. | 148/3 |
| 4,419,143 | A | 12/1983 | Ito et al. | 148/3 |
| 5,846,350 | A | 12/1998 | Bergsma | 148/549 |
| 6,267,829 | B1 * | 7/2001 | Backerud et al. | 148/415 |

OTHER PUBLICATIONS

"Aluminium–Taschenbuch 14 Auflage, Seiten 872 bis 877" 1986, Aluminium Verlag, Dusseldorf, DE XP002146538.

Optimization of Al–Si Cast Alloys for Cylinder Head Applications, AFS Transactions, vol. 61, 1998, pp. 225–231.

* cited by examiner

*Primary Examiner*—George Wyszomierski
*Assistant Examiner*—Janelle Combs Morillo
(74) *Attorney, Agent, or Firm*—Darby & Darby

(57) ABSTRACT

The present invention relates to a cylinder head and motor block casting and a method of making the same, including an aluminum alloy having the following composition: Si 6.80–7.20, Fe 0.35–0.45, Cu 0.30–0.40, Mn 0.25–0.30, Mg 0.35–0.45, Ni 0.45–0.55 Zn 0.10–0.15, Ti 0.11–0.15 with the remainder being aluminum as well as unavoidable impurities with a maximum content of 0.05 each, but not more than a maximum of 0.15 impurities in all.

3 Claims, No Drawings

CYLINDER HEAD AND MOTOR BLOCK CASTINGS

This is a division, of application Ser. No. 09/585,091, filed Jun. 1, 2000. The prior application is hereby incorporated herein by reference, in its entirety.

BACKGROUND OF THE INVENTION

1. Field of the Invention

The present invention relates to a cylinder head and motor block casting, including an aluminum alloy having the following composition: Si 6.80–7.20, Fe 0.35–0.45, Cu 0.30–0.40, Mn 0.25–0.30, Mg 0.35–0.45, Ni 0.45–0.55 Zn 0.10–0.15, Ti 0.11–0.15 with the remainder being aluminum as well as unavoidable impurities with a maximum content of 0.05 each, but not more than a maximum of 0.15 impurities in all.

2. Description of the Related Art

The properties of aluminum depend on a number of factors whereby added or accidentally present admixtures and impurities of other elements play an important part. The main alloying elements are copper (Cu), silicon (Si), magnesium (Mg), zinc (Zn) and manganese (Mn).

It often happens that the following impurities or additions are contained in small quantities: iron (Fe), chromium (Cr) and titanium (Ti). The following additions are used for special alloys: nickel (Ni), cobalt (Co), silver (Ag), lithium (Li), vanadium (V), zirconium (Zr), tin (Sn), lead (Pb), cadmium (Cd) and bismuth (Bi).

All alloy constituents are completely solvable in liquid aluminum at a high enough temperature. The solubility in the solid state with formation of solid solutions is limited for all elements; there is no alloy system comprising aluminum which shows a uninterrupted solid solution sequence. The unsolved parts form their own phases, so-called heterogeneous constituents, in the alloy micro structure. They are often hard and brittle crystals made up of one element alone (e.g. Si, Zn, Sn, Pb, Cd, Bi) or consisting of intermetallic compounds comprising aluminum (such as $Al_2Cu$, $Al_8Mg_5$, $Al_6Mn$, $Al_3Fe$, $Al_7Cr$, $Al_3Ni$, AlLi). Alloys having two or more constituents contain in addition to these intermetallic compounds, yet other intermetallic compounds consisting of the additions (e.g. $Mg_2Si$, $MgZn_2$), ternary phases (e.g. $Al_8Fe_2Si$, $Al_2Mg_3Zn_3$, $Al_2CuMg$) and phases comprising even more constituents. The formation of solid solutions and the formation of the heterogeneous micro structure constituents (their amount, size, form and distribution) determine the physical, chemical and technological properties of an alloy. Due to the fact that the diffusion rate decreases with temperature it is possible, after a rapid cooling from higher temperatures, that Al-solid solutions may contain higher levels of solved elements than would be possible in equilibrium at room temperature. In such over saturated solid solutions precipitation processes may occur at room temperature or at moderately raised temperatures (partly with formation of metastable phases), these may be of great influence on the properties. Elements which diffuse slowly such as Mn can be over saturated far beyond the maximum equilibrium solubility by rapid solidification from the melt. This over saturation may be remedied by annealing at high temperatures. The additions are then precipitated in a finely dispersed manner. Often this annealing process (full annealing) is used for compensating micro segregation.

Below some important binary and ternary systems are described with short explanations:

Aluminum-copper

In the range of 0 to approximately 53% Cu there is a simple eutectic sub-system with a eutetic at 33.2% Cu and 547° C. The maximum solubility at the eutectic temperature in the alpha solid solution is 5.7%. The solubility decreases with falling temperature and is only 0.45% at 300° C. Unsolved copper is present in the form of $Al_2Cu$ in the state of equilibrium. Metastable transition phases may be formed at medium temperatures by precipitation from the oversaturated solid solution.

Aluminum-silicon

This system is purely eutectic having a eutetic at 12.5% Si and 577° C. At this temperature 1.65% Si are solvable in the alpha solid solution. At 300° C. only 0.07% are solvable. The crystallisation of eutectic silicon may be influenced by small amounts of additions (e.g. of sodium or strontium). In this case an overcooling and shift of concentration of the eutectic point occur in dependence on the solidification rate.

Aluminum-magnesium

The subarea between 0 and approx. 36% Mg is eutectic. The eutetic is at approximately 34% Mg and 450° C. At this temperature the (maximum) solubility is 17.4% Mg. At 300° C. 6.6% and at 100° C. about 2.0% Mg are solvable in the alpha solid solution. In most cases unsolved Mg is present in the microstructure in the form of the β-phase ($Al_8Mg_5$).

Aluminum-zinc

The alloys form a eutectic system having a high-level zinc eutetic at 94.5% Zn and 382° C. In the area high in aluminium, which is of interest here, 31.6% Zn are solvable at 275° C. in the solid solution. The solubility is very much dependent on the temperature and falls to 14.5% at 200° C. and to 3.0% at 100° C.

The systems of aluminum-manganese, aluminum-iron and aluminum-nickel show a eutetic at a low concentration. The melting point is only very slightly lowered. The solubility in the solid state is low except that of manganese.

From the journal AFS Transactions, Volume 61, 1998, pages 225 to 231, it has been known to optimize aluminum-silicon cast alloys for cylinder heads by adding copper to them. In this case the thermal strength of an $AlSi_7Mg$-alloy, to which 0.5 to 1% copper had been added, increased significantly whereby simultaneously the creep resistance also improved. The improvement of the mechanical properties, however, is accompanied by a deterioration of ductility and a reduced corrosion resistance.

After having manufactured the cylinder head and motor block castings in a casting process it is often necessary to carry out machining operations on them. In certain alloys problems occur as a result of too little hardness because the surfaces of the castings become very soft so that fine scoring or smudging may occur.

Furthermore, such alloys must have a high thermal conductivity so that the castings are suitable for use in motors. The piston alloys with 12% Si which have been examined by way of comparison do not meet the requirements, nor does the normally used AlSi9Cu3.

SUMMARY OF THE INVENTION

Therefore, an object of the present invention is to provide an alloy suitable for use in cylinder head and motor block castings, having a high thermal conductivity and an appropriate crystalline structure, high thermal strength, good creep resistance as well as sufficient ductility and, at the same time, having low vulnerability to corrosion and being easily machinable.

According to the present invention this object is accomplished by the features in the claims.

The research of the inventors has shown that cylinder head and motor block castings consisting of an aluminum alloy comprising the following composition:

Si 6.80–7.20
Fe 0.35–0.45
Cu 0.30–0.40
Mn 0.25–0.30
Mg 0.35–0.45
Ni 0.45–0.55
Zn 0.10–0.15
Ti 0.11–0.15 remainder aluminum as well as unavoidable impurities with a maximum content of 0.05 each, but not more than a maximum of 0.15 impurities in all, exhibits an especially high creep resistance and thermal strength, if phases in the amounts of 1 to 3 vol. % of the aluminum-nickel type, aluminum copper type, aluminum-manganese type, aluminum-iron type and mixed phases of the aforementioned types are contained and if, in particular, a ratio of Ni:Mg:Cu=5:4:3.5 is observed. The thermal conductivity and ductility of a cylinder head and motor block casting are improved by a crystalline structure consisting of an alpha aluminum matrix structure having 40 to 55 vol. % and by observing a Mn/Fe-ratio of at least 0.781. If the aluminum alloy elements are contained in the following ratios Si:Fe:Cu=7:0.4:0.35
Ni:Mg:Cu=5:4:3.5 the cylinder head and motor block casting according to the present invention shows very good corrosion properties. It was found that cylinder head and motor block castings are easier to machine and have an improved hardness when they are produced in the following way:

An aluminum alloy is filled into a casting mold at a temperature of 720° to 740° C., then the aluminum alloy is subjected to cooling at a cooling rate of 0.1–10 K $s^{-1}$ and after cooling to room temperature a thermal treatment is carried out consisting of a solution heat treatment at 530° C. for 5 hours, chilling in water at 80° C. and artificial ageing at a temperature of 160 to 200° C. for 6 hours.

Several examples of embodiments are given below, from which the processing advantages become obvious which result from an increased hardness and a better machinability combined therewith as well as a reduced vulnerability to corrosion while the good mechanical properties are maintained (Table 1). A nickel-alumiumium alloy known from the Aluminum-Taschenbuch 14th Edition, page 35 was examined as comparison example to the alloys according to the present invention. It was found that only a low thermal conductivity could be measured due to the high eutectic portion.

The assessment of the processibility is based on a comparison of hardness wherein the individual values were obtained in an indentation test according to Brinell. For the alloy according to the present invention a hardness of 100 to 105 HB was measured in contrast to 85 to 90 HB for the compared alloy.

The particularly high degree of hardness measured for the alloy of the invention could be achieved by a special artificial ageing. In this treatment the following parameters were observed:

casting temperature: 730° C.
cooling rate: approx. 1 to 5 K/s
solution heat treatment at 530° C. for 5 hours
chilling in water of 80° C.
artificial ageing at 180° C. for 6 hours A corrosion comparison with a copper-containing alloy (0.5% copper of alloy No.6) showed a distinctive improvement of the corrosion resistance (in view of the State of the Art) and especially in view of the conventionally used alloys, such as alloy No. 5 which has so far been used for the production of cylinder heads and motor block castings. Thus, it may be assumed that the use of the alloy according to the present invention results in achieving a substantial improvement of the corrosion properties when copper is replaced by nickel, wherein the special thermal treatment as previously described and the concentration limits as defined in claim 1 helped in the advantageous formation of the phases (i.e. in the extensive spheroidizing of the phases) of the aluminum-copper type and the magnesium-silicon type.

The obtained degrees of hardness were not only decisively influenced by the individually used phase types but also by their distribution and fineness as well as their amounts measured in volume percent. The amount was determined by means of quantitative image analysis of statistically distributed sections, whereas the phase types were determined by micro probe examination. While State of the Art alloy No. 6 (Table 1) contained only 0.5 vol. % of the Cu-containing phase, the alloy of the present invention shows finely distributed intermetallic phases of an average length of 20 $\mu$m maximum of the types aluminum-nickel, aluminum-copper and aluminum-iron-manganese, wherein the volume proportion was at least 1 vol. % which is to be considered an important reason for the improvement in thermal strength.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

TABLE 1

| | Si | Fe | Cu | Mn | Mg | Ni | Zn | Ti | Distribution of phases Si:Fe:Cu | Fe:Mn | Mg:Ni | Hardness HB | Corro-sion |
|---|---|---|---|---|---|---|---|---|---|---|---|---|---|
| Invent. Alloy 1 | 6.8 | 0.35 | 0.30 | 0.25 | 0.35 | 0.45 | 0.10 | 0.11 | 7:0.4: 0.35 | 1:0.7 | 4:5 | 105 | + |
| Invent. Alloy 2 | 6.93 | 0.38 | 0.33 | 0.26 | 0.38 | 0.48 | 0.12 | 0.12 | | | | 100 | + |
| Invent. Alloy 3 | 7.07 | 0.41 | 0.37 | 0.28 | 0.42 | 0.52 | 0.13 | 0.13 | | | | 102 | + |
| Invent. Alloy 4 | 7.20 | 0.45 | 0.40 | 0.30 | 0.45 | 0.55 | 0.15 | 0.15 | | | | 104 | + |
| Compar. Alloy 5 | 8.86 | 0.650 | 2.40 | 0.520 | 0.27 | 0.010 | 0.270 | 0.121 | — | — | — | 90 | – |
| Compar. Alloy 6 | 7.13 | 0.125 | 0.50 | 0.005 | 0.36 | 0.004 | 0.006 | 0.007 | — | — | — | 85 | – |

What is claimed is:

1. A cylinder head and motor block casting, comprising an aluminum alloy having the following composition:

Si 6.80–7.20

Fe 0.35–0.45

Cu 0.30–0.40

Mn 0.25–0.30

Mg 0.35–0.45

Ni 0.45–0.55

Zn 0.10–0.15

Ti 0.11–0.15, the remainder being aluminum and impurities of a maximum content of 0.05 each, but not more than a maximum of 0.15 impurities in all, and at least 1 vol. % intermetallic phases selected from the group consisting of aluminum-nickel, aluminum-copper, aluminum-manganese, aluminum-iron, and mixtures thereof.

2. The cylinder head and motor block casting according to claim 1, having the following crystalline structure a) 40 to 60 vol. % of an alpha aluminum matrix structure;

b) 40 to 55 vol. % of an eutectic aluminum-silicon phase; and c) further phases comprising 1 to 3 vol. % of aluminum and alloying constituents iron, copper, magnesium, nickel and silicon.

3. The cylinder head and motor block casting according to claim 2, wherein the ratios of the aluminum alloy elements are as follows:

a) Si:Fe:Cu=7:0.4:0.35;

b) Fe:Mn=1:0.7; and c) Ni:Mg:Cu=5:4:3.5.

* * * * *